US011242694B2

(12) United States Patent
Bucarizza

(10) Patent No.: US 11,242,694 B2
(45) Date of Patent: Feb. 8, 2022

(54) BASE FOR A FENCE POST

(71) Applicant: Cochrane USA, Inc., Washington, DC (US)

(72) Inventor: Vlado Bucarizza, Dubai (AE)

(73) Assignee: COCHRANE USA, INC., Washington, DC (US)

( * ) Notice: Subject to any disclaimer, the term of this patent is extended or adjusted under 35 U.S.C. 154(b) by 0 days.

(21) Appl. No.: 16/180,414

(22) Filed: Nov. 5, 2018

(65) Prior Publication Data

US 2019/0136567 A1 May 9, 2019

(51) Int. Cl.

| | |
|---|---|
| ***E04H 12/22*** | (2006.01) |
| ***E04H 17/22*** | (2006.01) |
| ***E01F 9/692*** | (2016.01) |
| *E04H 17/16* | (2006.01) |
| *E04H 17/20* | (2006.01) |

(52) U.S. Cl.

CPC ..... *E04H 12/2238* (2013.01); *E01F 9/692* (2016.02); *E04H 12/2284* (2013.01); *E04H 17/22* (2013.01); *E04H 17/161* (2013.01); *E04H 17/20* (2013.01)

(58) Field of Classification Search

CPC . E04H 12/2238; E04H 17/22; E04H 12/2284; E04H 17/08; E04H 17/16; E04H 17/161; E04H 17/163

USPC ..... 52/292, 296; 405/229

See application file for complete search history.

(56) References Cited

U.S. PATENT DOCUMENTS

| | | | | | |
|---|---|---|---|---|---|
| 90,611 | A * | 5/1869 | Name not available | E04H 12/2269 | 52/298 |
| 576,843 | A * | 2/1897 | Name not available | E02D 31/02 | 405/229 |
| 3,282,001 | A * | 11/1966 | Bigalow | E04H 12/2269 | 52/292 |
| 4,417,426 | A * | 11/1983 | Meng | E04B 1/34352 | 52/126.7 |
| 4,469,956 | A * | 9/1984 | D'Amato | F03D 13/22 | 290/55 |
| 4,899,497 | A * | 2/1990 | Madl, Jr. | E04B 1/0007 | 52/126.6 |
| 4,972,641 | A * | 11/1990 | Barrios | E02D 5/38 | 249/48 |
| 5,431,196 | A * | 7/1995 | Forrester, Jr | E04G 21/123 | 140/93.6 |
| 5,697,190 | A * | 12/1997 | Scribner | E04H 12/2223 | 248/530 |
| D443,937 | S * | 6/2001 | Prokop | D25/133 | |
| 6,347,489 | B1 * | 2/2002 | Marshall, Jr | E02D 27/00 | 248/354.5 |
| 6,868,641 | B2 * | 3/2005 | Conner | E01F 9/635 | 52/165 |
| 6,948,283 | B2 * | 9/2005 | Burkart | B29C 33/005 | 248/346.01 |

(Continued)

*Primary Examiner* — Brian E Glessner
*Assistant Examiner* — Adam G Barlow
(74) *Attorney, Agent, or Firm* — Tutunjian & Bitetto, P.C.

(57) ABSTRACT

A base for a subterranean fence post which includes a body with a ground-engaging surface and a mechanism for mounting a lower end of the fence post to the body wherein a footprint of the surface is sufficient to provide lateral support to maintain the post in an upright orientation and a mass of the body is sufficient to stabilize the upright post.

5 Claims, 7 Drawing Sheets

(56) References Cited

U.S. PATENT DOCUMENTS 7,055,251 B1 * 6/2006 Smith ..... E02D 13/04 14/77.3
7,278,240 B2 * 10/2007 Burkart ..... B29C 33/005 248/346.01
D586,481 S * 2/2009 Blair ..... D25/133
7,707,797 B2 * 5/2010 Henderson ..... F03D 13/22 52/745.17
7,850,148 B2 * 12/2010 Collins, IV ..... E04H 17/20 256/65.14
8,056,299 B2 * 11/2011 Liskey ..... E02D 27/42 52/742.14
8,572,905 B1 * 11/2013 Driggers ..... E02D 27/12 52/169.9
8,752,338 B2 * 6/2014 Schaefer ..... F24S 25/70 52/60
8,833,020 B2 * 9/2014 Oliver ..... E02D 31/14 52/292
8,863,455 B2 * 10/2014 Cariaga ..... E02D 27/02 52/299
8,959,857 B1 * 2/2015 Lin ..... E04H 12/2261 52/296
9,109,874 B2 * 8/2015 Simmons ..... E04G 17/14
9,138,812 B2 * 9/2015 Stalemark ..... E04H 12/2261
9,194,095 B2 * 11/2015 Cariaga ..... E02D 27/02
9,347,196 B2 * 5/2016 Wagler ..... E02D 27/42
2003/0140578 A1 * 7/2003 Moreno, Jr. ..... E02D 27/01 52/169.1
2003/0213197 A1 * 11/2003 Oliver ..... E02D 27/01 52/299
2004/0069922 A1 * 4/2004 Wu ..... E04H 12/2246 248/519
2005/0072067 A1 * 4/2005 Wobben ..... F03D 13/22 52/155
2005/0072068 A1 * 4/2005 Burkart ..... B29C 33/005 52/155
2007/0056226 A1 * 3/2007 Angelo ..... E02D 27/48 52/169.9
2007/0056227 A1 * 3/2007 Angelo ..... E02D 27/48 52/169.9
2007/0144083 A1 * 6/2007 Angelo ..... E02D 29/0258 52/169.9
2008/0222976 A1 * 9/2008 Liskey ..... E02D 27/42 52/169.9
2009/0038240 A1 * 2/2009 Leonard ..... E04B 1/34347 52/169.9
2010/0031587 A1 * 2/2010 Weeks ..... E04F 15/02183 52/126.6
2010/0307073 A1 * 12/2010 Oliver ..... E02D 31/14 52/169.9
2011/0296770 A1 * 12/2011 Fehr ..... E04C 3/30 52/169.9
2012/0085050 A1 * 4/2012 Greenwood ..... E04B 1/41 52/296
2012/0174510 A1 * 7/2012 Mollick ..... A63G 31/00 52/292
2012/0186909 A1 * 7/2012 Chilton ..... E04H 17/1417 182/113
2012/0304555 A1 * 12/2012 Oliver ..... E02D 27/01 52/157
2014/0059957 A1 * 3/2014 Stark ..... E02D 27/42 52/292
2014/0115978 A1 * 5/2014 Fairbairn ..... E04H 12/2276 52/126.1
2014/0157688 A1 * 6/2014 Bertke ..... E02D 27/42 52/126.1
2015/0013242 A1 * 1/2015 Andersen ..... F03D 80/00 52/123.1
2015/0323124 A1 * 11/2015 Erdos ..... A47B 13/00 29/428
2016/0230365 A1 * 8/2016 Shi ..... E02D 27/02

* cited by examiner

BASE FOR A FENCE POST

BACKGROUND OF THE INVENTION

The invention relates to a base for a post of a fence which is erected on a ground support which is not to be penetrated e.g. because the ground support is on rock or concrete, or because the fence is of a temporary nature.

Conventionally a post, used to support a side of a fence panel or barrier, has a portion of its length which is set into the ground and which is usually embedded in concrete, thereby keeping the post upright and stable. It can be time consuming to erect an entire fence structure which requires each post to be planted in the ground. This endeavour is undertaken when permanent fence structures are erected.

If a temporary fence is to be erected or if a fence is on ground which is difficult to penetrate or which is not to be penetrated, use is made of superterranean posts. Each superterranean post includes a ground-engaging base formation on which an upright post is supported. This type of fence structure can be erected quickly but can also be unstable and may not be suitable for high security purposes.

An object of the current invention is to provide a base for a stable superterranean post for a fence.

SUMMARY OF THE INVENTION

The invention provides a base for supporting a superterranean fence post, the base including a body with a ground-engaging surface and a mechanism for mounting a lower end of the fence post to the body, a footprint of the surface being sufficient to provide lateral support to maintain the post in an upright orientation (in use) and a mass of the body being sufficient to stabilise the upright post.

The body may be modular to allow assembly of various components of the base at a site where a fence panel is to be erected.

Preferably the body is formed from a plurality of the components arranged in a succession of overlying layers.

A first layer may be supported on a foundation member. The foundation member may form the ground-engaging surface.

The foundation member may be in the form of a sheet of durable material e.g. of metal, or of a hard plastic of a suitable grade and thickness.

The first layer may be fastened to the foundation member and each following layer may be fastened to the layer beneath it.

The mechanism may be in the form of a plate fastened at least to an upper end of the base e.g. a topmost layer of the components.

Each component may be a respective elongate steel beam e.g. an I-beam. Beams which make up one layer may be stacked to lie transverse to the lengths of beams which make up an adjacent layer directly above or below the layer in question.

The body may include a shell which rests on the foundation member and covers the layers. The shell may be made from sheet metal or a mesh material e.g. one or more mesh panels.

The footprint may be adjusted, using a suitable adjustment mechanism during erection of the post, to accommodate an uneven ground level. The adjustment mechanism may include at least one foot member which is positioned underneath the ground-engaging surface. The foot member may for example be a length of a beam.

Preferably the footprint has a minimum width equal to at least one third of a height of the fence post.

BRIEF DESCRIPTION OF THE DRAWINGS

The invention is further described by way of examples with reference to the accompanying drawings.

DESCRIPTION OF PREFERRED EMBODIMENTS

Figure 1:
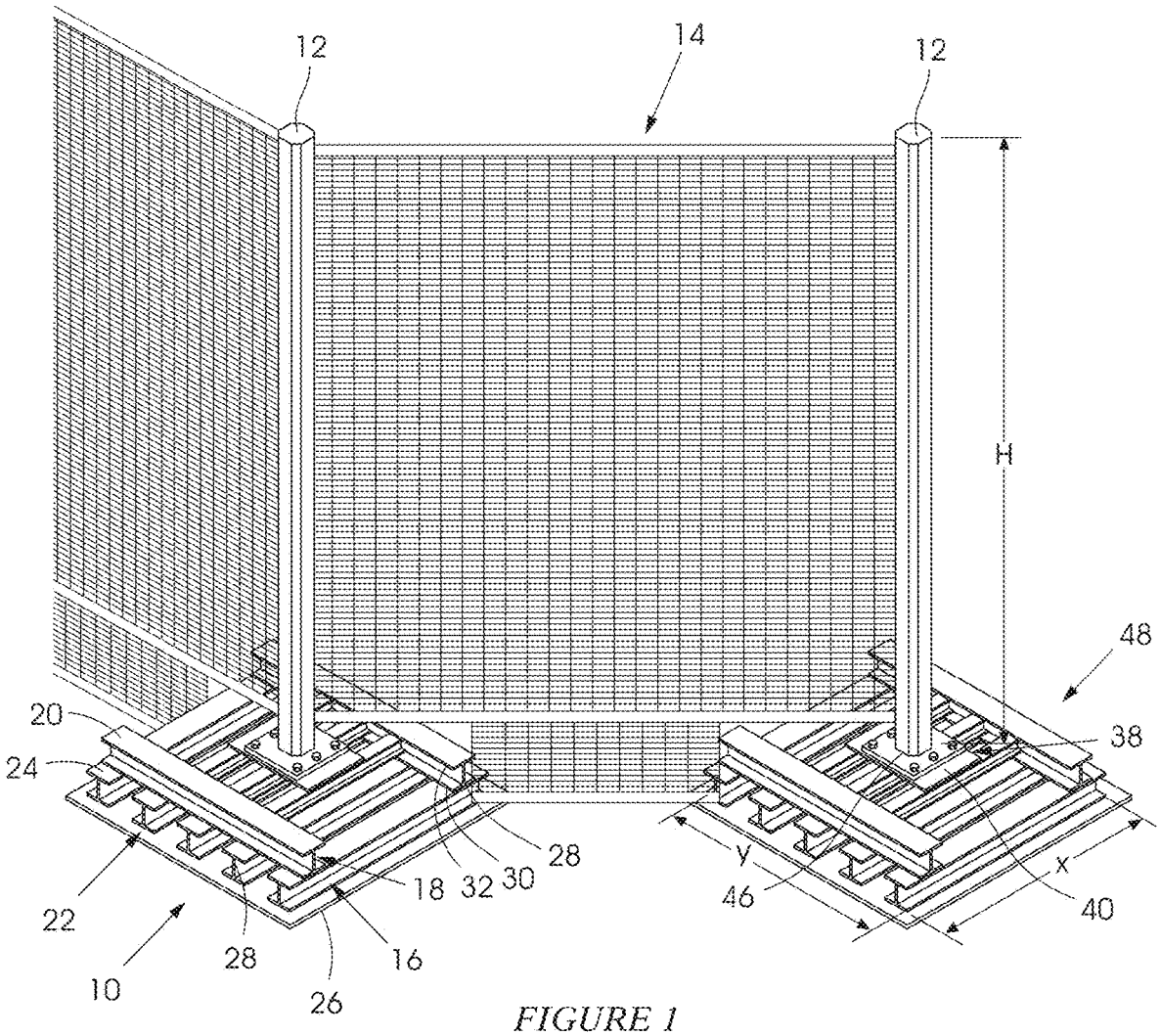
FIG. 1 shows a base, from a first angle, for a superterranean post for a fence.
Figure 2:
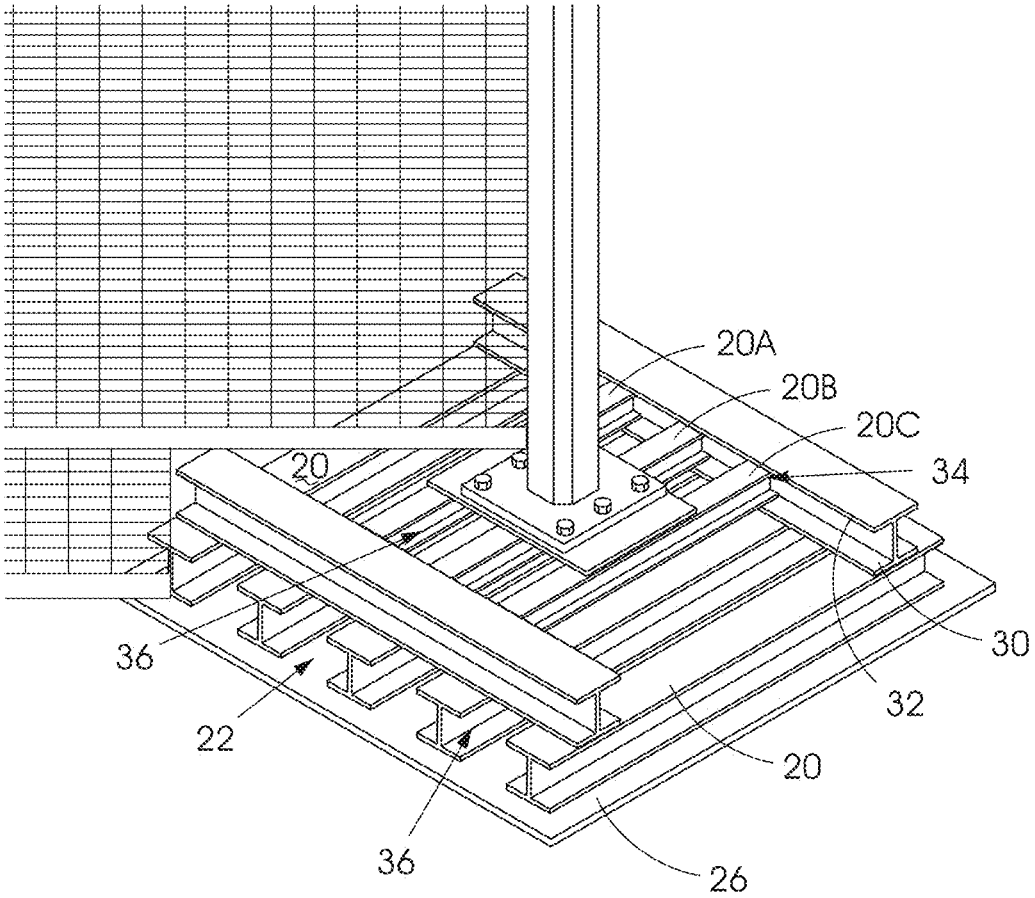
FIG. 2 shows the base of FIG. 1 from another angle.

FIGS. 1 and 2 show a base 10 for a subterranean post 12 used to erect a fence structure 14.

The base 10 includes a body 16 with a first layer 18 comprising a plurality of lengths of I-beams 20 and a second layer 22 comprising two lengths of I-beams 24 which are stacked on top of and transverse to the beams 20. The body 16 is supported on a foundation 26, e.g. a steel plate, which forms a ground-engaging surface and which defines a footprint of the base 10.

Each I-beam length 20, 24 respectively comprising an elongate member 27 with a web 28 extending between two spaced apart flanges 30 and 32.

Figure 3:
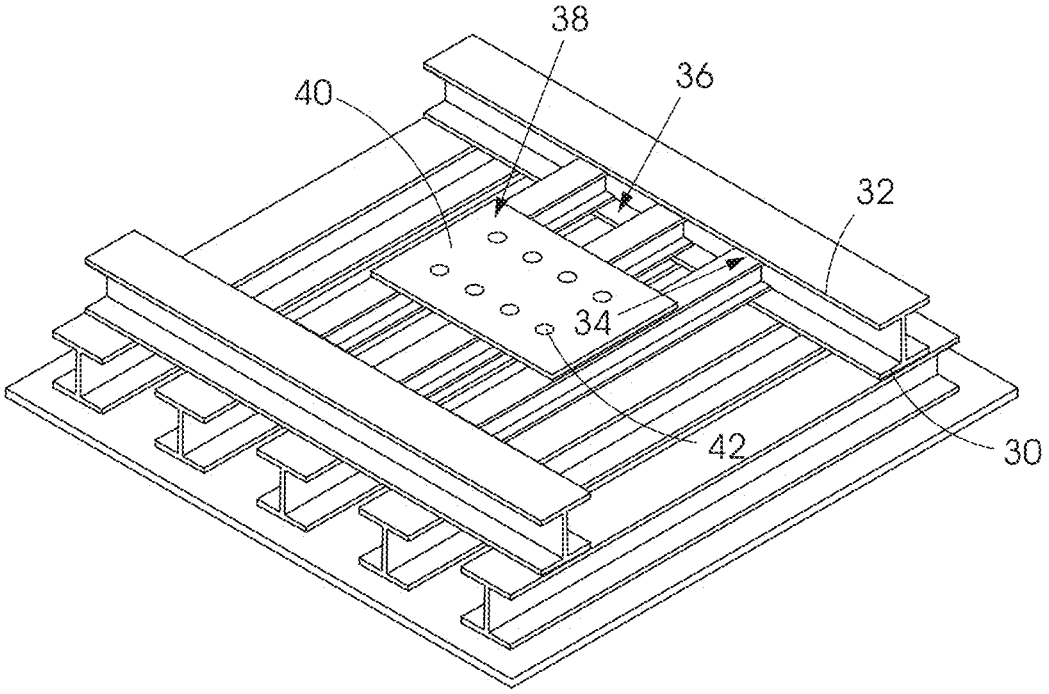
FIG. 3 shows an attachment mechanism for attaching a fence post to the base of FIG. 1.
Figure 4:
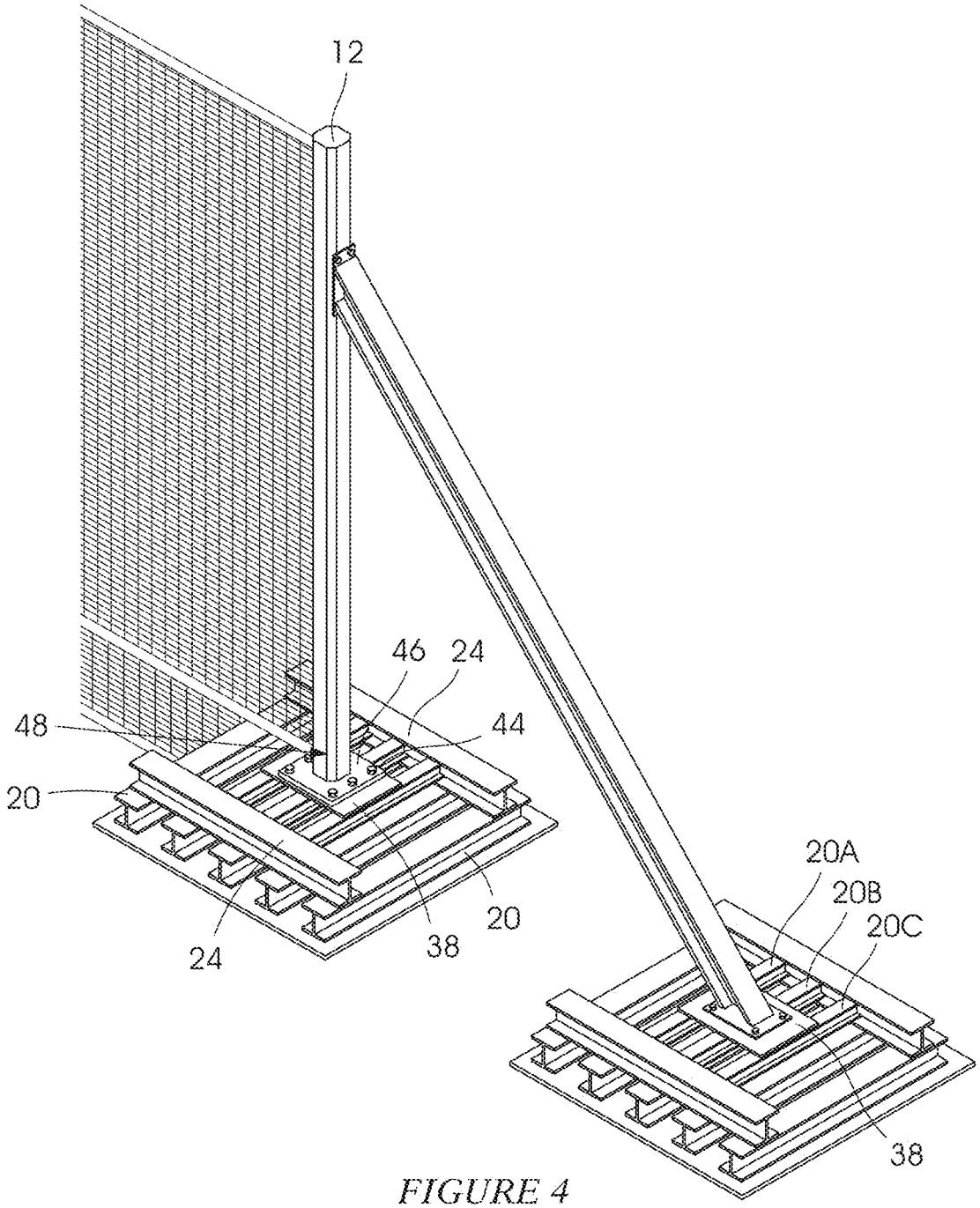
FIG. 4 shows, as an example of a variation of use of an attachment mechanism, a lateral support member attached to the attachment mechanism of FIG. 3.

The second layer 22 includes three intermediate I-beams 20A, 20B, 20C which are mounted parallel to the beams 20 with respective ends 34 and 36 (of the intermediate beams) fitted between the flanges 30 and 32 of the beams 24 to define a surface 36 to which a mounting plate mechanism 38 (FIGS. 3 and 4) is attached.

The mechanism 38 comprises a plate 40 with a plurality of apertures 42 for receiving bolts 44 used to fasten a flange 46, located at a lower end 48 of the post 12, to the plate 40 which is an upper end or surface of the base.

Figure 5:
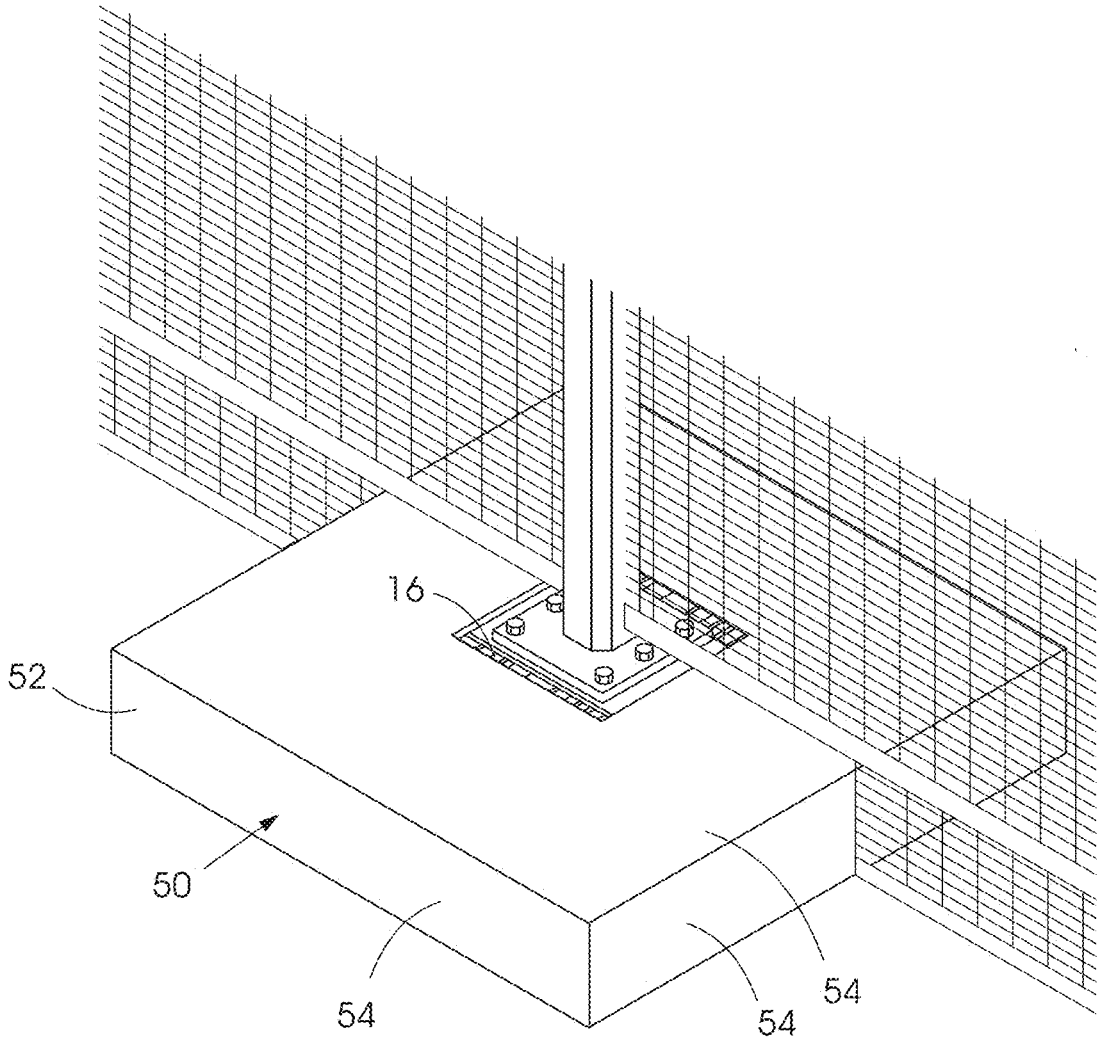
FIG. 5 shows a first embodiment of a shell used to cover a body of the base of FIG. 1.
Figure 6:
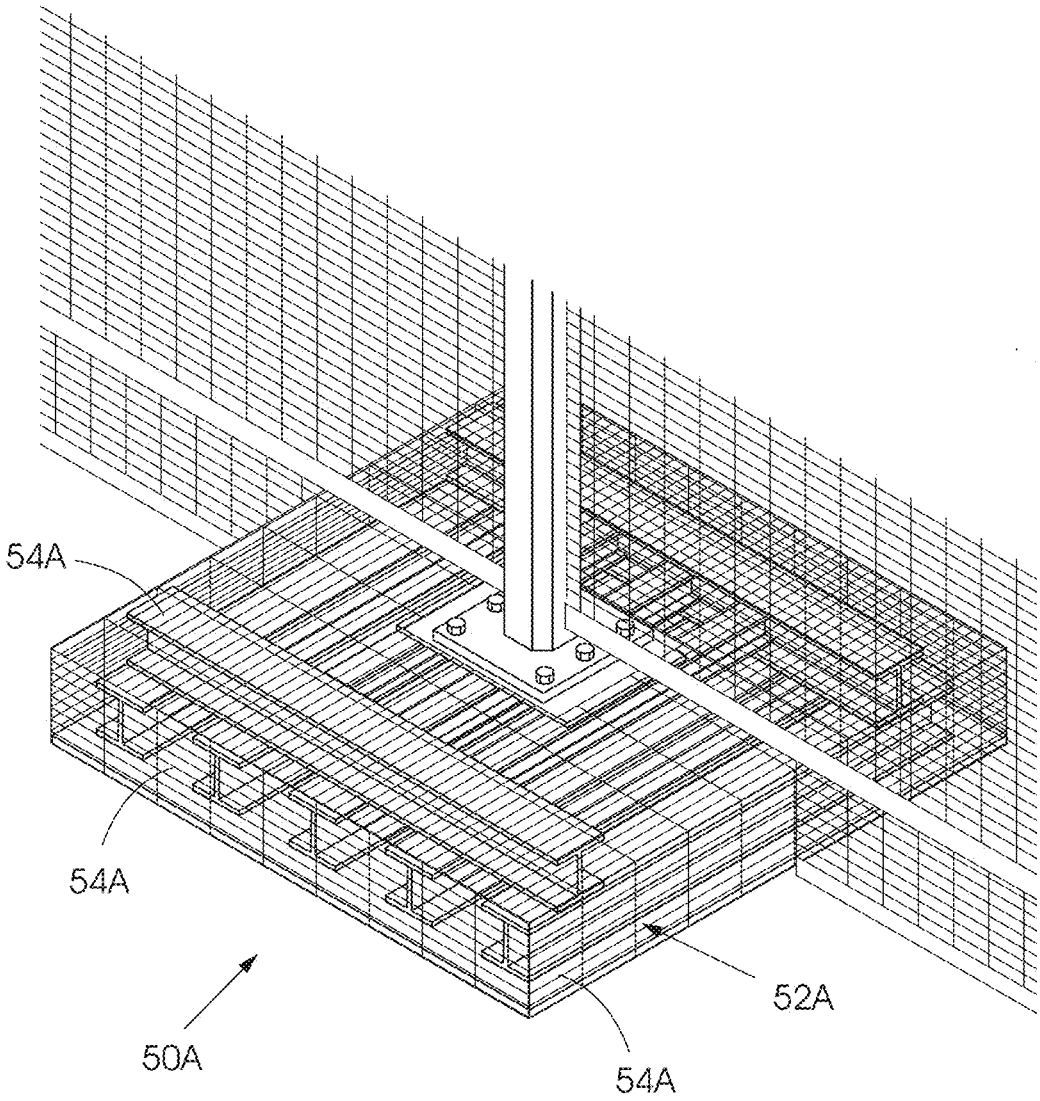
FIG. 6 shows a second embodiment of a shell used to cover a body of the base of FIG. 1.

FIG. 5 shows an embodiment of a shell 50 used to cover the body 16. The shell 50 comprises a box 52 constructed from sheets 54 of metal. FIG. 6 shows a shell 50A which comprises a box 52A constructed from panels 54A of mesh. This is non-limiting.

The various components used to construct the base 10 can be transported to a site where the base 10 can be assembled. Alternatively, the base 10 can be transported to the site as a whole.

Figure 7:
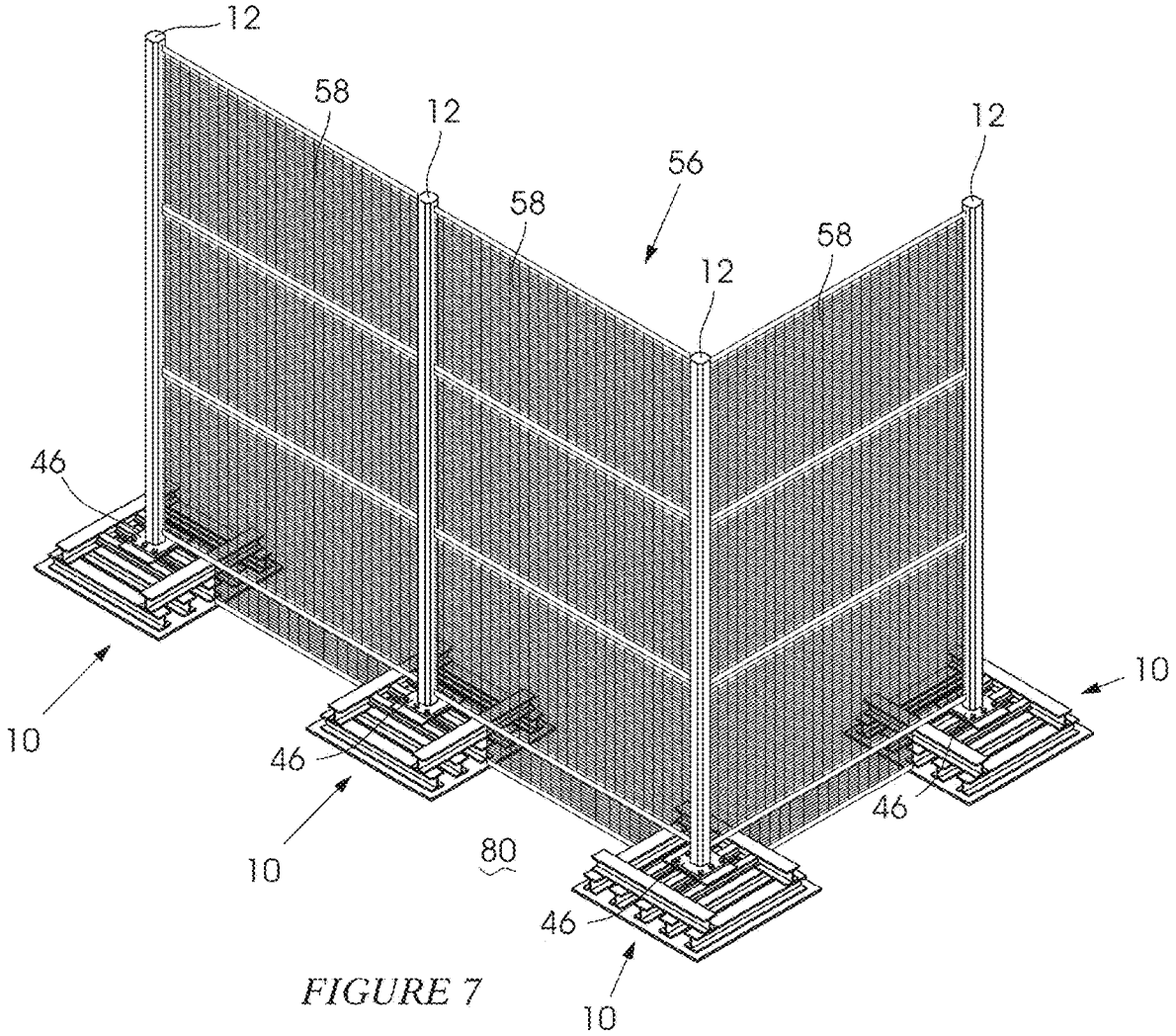
FIG. 7 shows a fence that was erected using several bases of the kind shown in FIG. 1.

In use, a fence 56 (FIG. 7) is erected by laying down (or assembling) a plurality of bases 10 on a ground-surface according to the desired layout of the fence 56 and attaching to the mounting plate mechanism 38 of each base 10 a flange 46 of a respective fence post 12. Fence panels 58 are then mounted between and secured to the erected fence posts 12.

The fence panels 58 are made from a high density metallic mesh which has substantial mass and rigidity. Thus when the panels are fixed to the posts, the panels materially add to the stability, and hence the effectiveness of the erected fence.

A footprint of the base 10 is dimensioned to ensure that the post 12, on the base, is securely kept in an erect orientation. The size (area) of the base and the substantial weight of the base 10 (due to its size and the material used to manufacture) serve to stabilise the post 12 on the base. The area of the base is typically one-third of the height (H) of the fence post 12.

The base 10 supports the entire weight of the post 12 and it is not required to plant the post into a concrete pedestal to obtain a high level of stability.

Figure 8:
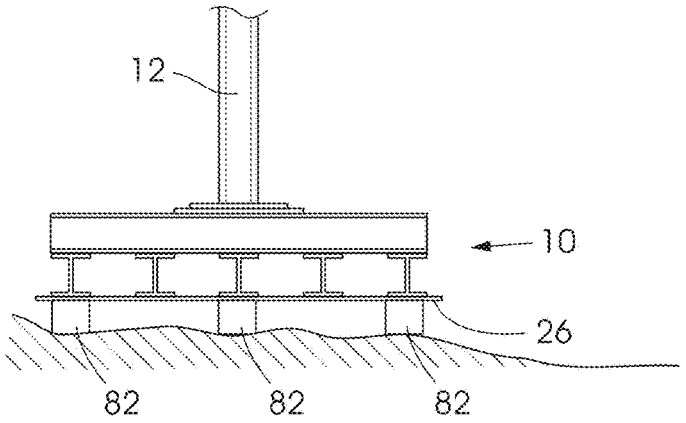
FIG. 8 shows a fence base according to FIG. 1 which includes a foot member for adjusting the base relative to an irregular ground level.

To adjust the footprint according to uneven ground levels i.e. to ensure that each post 12 is vertically installed, foot members 82 (FIG. 8) can be used to lift parts of the foundation 26 where necessary.

The invention claimed is:

1. A fence comprising:

a plurality of combinations, each combination comprising a respective super terranean fence post and a base for supporting the super terranean fence post, the base comprising:

a body having a ground-engaging sheet of material;

a first plurality of spaced apart steel beams which extend in a first direction, fastened to the sheet of material;

a second plurality of spaced apart steel beams which extend in a second direction, stacked on top of and fastened to the first plurality of beams;

the super terranean fence post comprising a plate fastened to an upper surface of the second plurality of beams and a vertically extending fence post which is fixed to the plate;

at least one ground-engaging foot member positioned underneath the sheet of material which foot member is adjustable to accommodate an uneven ground level during the erection of the super terranean fence post; and a shell which covers at least the first plurality of beams and the second plurality of beams, wherein said combinations are positioned so that said vertically extending fence posts are spaced apart from one another, and a plurality of fence panels, each panel having a metallic mesh sheet which is positioned between and fixed to a respective adjacent pair of vertically extending spaced apart fence posts.

2. The fence according to 1, wherein the shell is made from sheet metal or mesh material.

3. The fence according to claim 1, wherein the at least one ground engaging foot member is a length of a beam.

4. The fence according to claim 1, wherein a footprint of the sheet of material is sufficient to provide lateral support to maintain the vertically extending fence post in an upright orientation.

5. The fence according to claim 4, wherein the footprint has a minimum width equal to at least one third of a height of the super terranean fence post.

* * * * *